United States Patent [19]

Lorenz

[11] 4,130,292

[45] Dec. 19, 1978

[54] APPARATUS FOR PROPELLING A SKATE BOARD WITH WIND CURRENTS

[76] Inventor: A. Michael Lorenz, 421 55th St., Downers Grove, Ill. 60515

[21] Appl. No.: 826,633

[22] Filed: Aug. 22, 1977

[51] Int. Cl.[2] ..... A63C 3/00

[52] U.S. Cl. ..... 280/11.37 S; 114/39; 114/102; 280/87.04 A

[58] Field of Search ..... 280/11.37 S, 87.04 A, 280/1, 16, 213; 114/39, 43

[56] References Cited

U.S. PATENT DOCUMENTS

| | | | |
|---|---|---|---|
| 1,859,178 | 5/1932 | Sprinkle | 280/11.37 S |
| 3,349,741 | 10/1967 | Herbst | 114/43 X |
| 3,924,870 | 12/1975 | Spivack et al. | 280/11.37 S |
| 3,982,766 | 9/1976 | Budge | 280/11.37 S |

*Primary Examiner*—Joseph F. Peters, Jr.
*Assistant Examiner*—Milton L. Smith
*Attorney, Agent, or Firm*—McWilliams & Mann

[57] ABSTRACT

Apparatus for propelling a skate board with air currents. A base plate is releasably secured to the skate board by adjustable straps and has a swivel bearing member attached to the top surface of the plate. Receptacles in the swivel member receive a mast and control shafts and a bearing in the swivel member permits an upper portion of the member to be generally rotatable about an axis of the mast, without any appreciable tilting movement. The control shafts control the angular position of the mast and sail with respect to the base plate and skate board. A substantially transparent sail is affixed at various points along the mast and control handles for receiving the forces of the air currents to propel the skate board.

6 Claims, 5 Drawing Figures

APPARATUS FOR PROPELLING A SKATE BOARD WITH WIND CURRENTS

BACKGROUND OF THE INVENTION

This invention relates in general to apparatus which utilizes the forces of wind currents to propel other devices, and more particularly to apparatus for propelling a skate board from wind currents wherein a mast and sail are controllably rotatable, but not tiltable, with respect to the skate board.

Skate boards are basically a skate having an elongated board portion, usually without means for fastening to the feet of a person. The elongated board portion is generally of sufficient length to accomodate both feet of a person who stands on the board portion and rides the skate board on inclined surfaces. Skate boards of this character have been popular for sometime and are known to the prior art.

Similarly, various forms of sails are known to the prior art for taking advantage of the forces of air currents to either propel or to partially aid in propelling an associated device. Sails are most commonly associated with water navigation vessels.

SUMMARY OF THE INVENTION

The apparatus of the present invention takes advantage of air currents to propel a skate board while minimizing any interference in maintaining the balance of the person riding upon the skate board. In riding a skate board over various degrees of inclined surfaces, the person riding the skate board must constantly seek to maintain his balance thereon by adjusting to the movement of the skate board. That is, the skate board accelerates, decelerates and the elongated board portion of the skate board is continually changing in pitch. In order for the rider to remain on the skate board, he must maintain his balance thereon by adjusting to such conditions.

Accordingly, any device for propelling a skate board by air currents must minimize any interference with the rider of the skate board in maintaining his balance. The apparatus of the present invention has a base plate which generally overlies a portion of the top surface of the board portion of the skate board. Securing means, such as adjustable straps, secure the base plate to the board portion of the skate board. A bottom portion of a swivel member is firmly attached to the base plate near one end thereof, with the top portion of the swivel member having receptacles for receiving a mast and a pair of handle control members. Roller bearings between the top and bottom portions of the swivel member permit rotational movement about the axis of the mast and the angular position is controllable by the handle members. While the swivel member permits rotational movement, tilting motion about the axis of the mast is avoided by the bearing arrangement. This permits the rider of the skate board to more easily maintain his balance by gripping the handle member. The opposite would be true if tilting movement were permitted by the swivel member since the rider would have to substantially control the tilted position of the apparatus as well as maintain his balance.

The mast is preferably comprised of a plurality of sections of about equal length for ease of shipment by the manufacturer and for efficient storage by the user. The upper end of the mast has a tee end for attachment of a substantially transparent sail at various points therealong. The sail is also attached to the handle control members at various points.

Various other objects, features and advantages of the invention will become apparent from the following detailed disclosure when taken in conjunction with the drawings.

BRIEF DESCRIPTIONS OF THE DRAWINGS

DESCRIPTION OF THE PREFERRED EMBODIMENT

Figures 1, 2, 3, 4, 5:
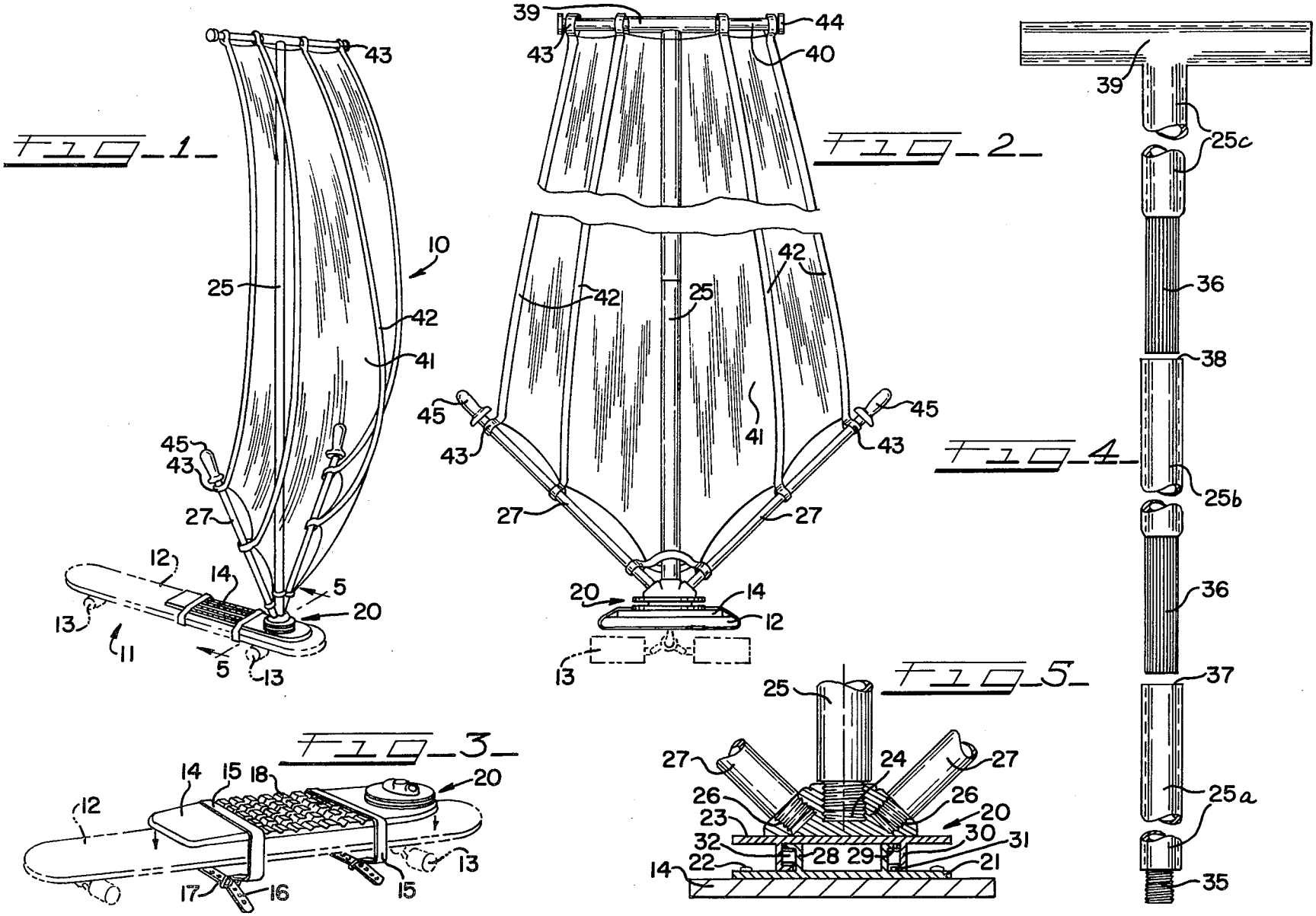
FIG. 1 is a perspective view, substantially in elevation, of the skate board propulsion apparatus according to the present invention, said apparatus shown mounted on a skate board which is shown in broken lines.
FIG. 2 is a fragmentary front elevational view of the skate board propulsion apparatus.
FIG. 3 is a perspective view of the base plate and swivel member of the propulsion apparatus showing attachment of the base plate to a skate board by means of adjustable straps.
FIG. 4 is an exploded, fragmentary view of the various sections of the mast.
FIG. 5 is a fragmentary sectional view along the sectional lines 5—5 in FIG. 1 illustrating the swivel member and engagement of the mast and handle control members therewith.

Turning to FIG. 1, the propulsion apparatus, generally designated 10, is shown mounted to a skate board, generally designated 11. The skate board 11 has an elongated board 12 usually suitable for accommodating both feet of a rider thereon. The board portion 12 is supported by pairs of wheels 13 attached to the underside of the board portion 12 near ends thereof.

The apparatus 10 has a base plate 14 suitable for overlying at least a portion of the upper surface of the board portion 12 of the skate board 11. Various means of securing the base plate 14 to the skate board 11 can be utilized. One efficient alternative which permits quick securement or removal is a pair of straps 15 (FIG. 3) having a plurality of apertures 16 therein to cooperate with buckles 17 for adjustment of the straps 15. The straps 15 can be fabricated from a variety of materials such as leather or plastics having adequate tensile strength.

Also as more clearly shown in FIG. 3, the base plate 14 may have a portion thereof with an irregular, anti-slip surface.

Near one end of the base plate 14 is provided a swivel member, generally designated 20. As illustrated in FIG. 5, the swivel member 20 has a lower portion 21 rigidly secured to the base plate 14 by any of a variety of fasteners, for example, rivets 22. An upper portion 23 of the swivel member 20 is provided with a receptacle 24 suitable for receiving a mast 25 in a generally vertical orientation. Two additional receptacles 26 are provided for receiving a pair of steering or control shafts 27 at an oblique angle to the mast 25. Each of the receptacles 24, 26 is threaded for receiving a respective threaded end of the mast 25 or shafts 27 for holding the same in rigid and fixed relation to the upper portion 23 of the swivel member 20.

In accordance with one aspect of the invention, the lower portion of the swivel member 20 has a tubular segment 28 rising upwardly from the portion 21 and terminating in outward flaring ends 29. The upper portion of the member 20 has a downwardly depending tubular segment 30 of larger diameter than the segment 28 such that the segment 30 can be placed over and substantially about the segment 28 in axial alignment. The segment 30 has an inwardly flaring end 31 and roller bearings 32 are interposed between the segments 28, 30 and the respective ends 29, 31 to complete a bearing arrangement between the lower portion 21 and the upper portion 23. The bearing arrangement permits the upper portion 23 with the mast 25 and shafts 27 to swivel in angular relationship to the lower portion 21 and the base plate 14 without permitting any appreciable tilting of the mast 25 with respect to the base plate 14. Tilting of the mast 25 is especially undesirable since the rider of the skate board 11 must maintain his balance. Requiring the rider to further control the tilting angle of the mast 25 makes control of the skate board with the attached propulsion device 10 increasingly difficult. That is, as will be better appreciated at a later point, the mast 25 receives forces from air currents. This further complicates the adjustment that must be made by the rider of the skate board 11 in order to both maintain his balance on the skate board 11 and compensate for varying forces from air currents on the apparatus 10.

Various other bearing arrangements which facilitate angular positioning of the apparatus 10 with respect to the skate board 11 to optimize the wind currents received by the apparatus 10, without permitting appreciable tilting of the mast 25, will be apparent. Another suitable substitute therefor is the provision of threads between the lower portion 21 and the upper portion 23 which permits angular displacement of the mast 25 without appreciable tilting.

Due to the fact that the mast 25 is the longest, rigid element in the apparatus 10, it is convenient, both from the manufacturer's standpoint in shipping the manufactured product and the user's standpoint in storing the apparatus 10 when not in use, to have the mast 25 consist of a plurality of sections 25*a*, 25*b*, 25*c*, as shown in FIG. 5. The lower mast section 25*a* has a threaded end 35 to engage with the receptacle 24 of the swivel member 20. The sections 25*b*, 25*c* have one end 36 of a reduced diameter for frictionally fitting within an opposite end 37, 38 of the respective sections 25*a*, 25*b*. The reduced diameter ends 36, 37 can either be formed by a swaging operation or by press fitting the sections 25*b*, 25*c* with a stud or the like. The ends 36 have longitudinal grooves or splines to prevent twisting or turning of one of the sections 25*a*, 25*b*, 25*c* with respect to one of the other sections. The section 25*c* has a tee end 39 for receiving and holding a tube 40 (FIGS. 1 and 2) in a substantially horizontal orientation.

Draped from the tube 40 is a substantially transparent sail 41. The sail 41 is preferrably fabricated from sheet plastic stock having sufficient transparency or translucency to give the rider of the skate board 11 an adequate view of what lies ahead. The sail 41 has a plurality of reinforcing ribs 42 which terminate in end loops 43 for securing sail 41 to the apparatus 10 and for transmitting forces of the air currents against the sail 41 to the apparatus 10. Along the top edge of the sail 41, the loops 43 are retained about the tube 40 by a larger diameter end plugs 44 or the like. Along the bottom edges of the sail 41, the end loops 43 are retained about the steering shafts 27 by enlarged handles 45. The sail may also be secured about the mast 25, especially where the mast 25 and shafts 27 terminate in the swivel member 20.

Since the mast 25 receives forces from the sail at the top of the mast 25 as well as at other locations therealong, it will be readily appreciated that the moments of inertia at the receptacle 24 can be significant. It is therefore important to reduce the effects caused by these moments of inertia between the base plate 14 and the skate board 11 by having a suitable relationship between the length of the mast 25 and the base plate 14. The length of the mast 25 should not generally exceed ten times the length of the base plate 14.

It will now be appreciated that by gripping and manipulating the handles 35, the rider of the skate board 11 can rotate the entire sail 41 to the best orientation for receiving air currents. That is, the upper portion 23 of the swivel member 20, the shafts 27, the mast 25 and the horizontal tube 40 are in fixed relationship such that the handles 45 control the angular position of each of these elements, enabling the sail 41 to be rotated to any desired angular position.

The apparatus 10 of the invention further offers economy of manufacture. The shafts 27, mast 25 and tube 40 can all be fabricated from inexpensive hollow metallic tubing. The base plate 14 can be fabricated in a variety of inexpensive ways including from sheet metal stock, metal casting, or plastic injection or molding processes. The sail 41 and the ribs 42 can be produced from a thin gauge of plastic sheet stock. The swivel member 20 is of uncomplicated construction and can similarly be manufactured at moderate cost.

It will be understood that various changes and modifications may be made without departing from the spirit of the invention as defined in the following claims, and equivalents thereof.

I claim:

1. Apparatus for propelling a skate board with air currents, said apparatus comprising:

a base plate;

means for securing said base plate to said skate board;

a swivel member with one end mounted to said base plate and an upper portion defining a mast receptacle at another end, said one end including an upstanding tubular segment and said upper portion including a depending tubular segment disposed about said upstanding tubular segment, said upstanding tubular segment having outwardly flaring ends and said depending tubular segment having an inwardly flaring end, and bearing means between said tubular segments providing free rotational movement of said mast receptacle in relation to said base plate without appreciable tilting movements therebetween;

a mast adapted for insertion into said mast receptacle in a generally vertical orientation;

handle control means in fixed relation to said mast for controlling the angular rotational position of said mast in relation to said base plate; and a substantially transparent sail supported by said mast and said handle control means for receiving air currents and for transmitting forces of such air currents to the apparatus for propelling the skate board.

2. The apparatus of claim 1 wherein said handle control means comprises at least one steering shaft with an enlarged handle at one end.

3. The apparatus of claim 1 wherein the length of said mast is less than ten times the length of said base plate.

4. Apparatus for propelling a skate board with air currents, said apparatus comprising:

a base plate;

means for securing said base plate to said board;

a swivel member with one end mounted to said base plate and defining a mast receptacle at another end, said swivel member providing free rotational movement about said mast receptacle without permitting any appreciable tilting movement of said receptacle in relation to said base plate;

a mast adapted for insertion into said mast receptacle in a generally vertical orientation;

handle control means in fixed relation to said mast for controlling the angular rotational position of said mast in relation to said base plate; and a substantially transparent sail supported by said mast and said handle control means for receiving air currents and for transmitting forces of such air currents to the apparatus for propelling the skateboard;

said swivel member comprising a lower portion mounted to the base plate, an upper portion for receiving the mast and the handle control means, and a bearing interconnecting the upper and lower portions for rotational movement therebetween.

5. The apparatus of claim 4 wherein an upper end of said mast terminates in a horizontally disposed tube for supporting said sail.

6. The apparatus of claim 4 wherein said handle control means comprises at least one steering shaft with an enlarged handle at one end, and said swivel member further defines a pair of shaft receptacles adapted for receiving a pair of steering shafts one in each shaft receptacle, each of said shafts oriented at an oblique angle to said mast when installed in said receptacle.

* * * * *